United States Patent [19]

Ferrill et al.

[11] Patent Number: 5,071,519

[45] Date of Patent: Dec. 10, 1991

[54] METHOD OF PLATING A FLEXIBLE DIELECTRIC MEMBER

[75] Inventors: Jess B. Ferrill, Madison; Randy G. Simmons, Clemmons, both of N.C.

[73] Assignee: AMP Incorporated, Harrisburg, Pa.

[21] Appl. No.: 475,624

[22] Filed: Feb. 6, 1990

Related U.S. Application Data

[63] Continuation-in-part of Ser. No. 431,505, Nov. 3, 1989, abandoned.

[51] Int. Cl.[5] ..... C25D 5/54

[52] U.S. Cl. ..... 205/164; 205/159

[58] Field of Search ..... 204/15, 20

[56] References Cited

U.S. PATENT DOCUMENTS 4,756,695 7/1988 Lane et al. ..... 439/76

OTHER PUBLICATIONS

Article in Connection Technology published Jun. 1989, entitled "Cast Spring-A Plated, Molded Thermoplastic Electrical I/O Interface".

*Primary Examiner*—T. M. Tufariello

[57] ABSTRACT

A method of plating a flexible plastic part is disclosed where serrations are provided on a flexible beam where the serrations are sinuous in shape. After molding the serrations onto the flexible beam, the component is electrically dipped to plate the component. The flexible beam can now be flexed without concern of cracking the plating along the length of the beam where the beam is flexed. A second embodiment shows an outlet box including two latch members along the sides which are bow shaped and have grounding surfaces thereon, which latch the outlet box in place to a panel, and simultaneously ground the box to the panel.

9 Claims, 7 Drawing Sheets

METHOD OF PLATING A FLEXIBLE DIELECTRIC MEMBER

This application is a continuation-in-part of patent application Ser. No. 431,505, filed Nov. 3, 1989, now abandoned.

BACKGROUND OF THE INVENTION

1. Field of the Invention

The invention relates to a method of producing, from a dielectric member, a flexible spring member with a metallic plated coating such that the flexure of the flexible member does not cause a propagation of a crack in the plating.

2. Description of the Prior Art

Many times it is desirable in, for example, electrical connection systems to electroplate or electrolytically plate a metallic coating on the exterior surface of a dielectric member. For example, in the event that shielding for EMI/RFI is desired, the plastic part is molded in a conventional manner and then dipped in an electrolytic plating bath whereby the plastic part takes on a metallic look with the metal plated on the exterior surfaces. Exterior coating also provides a direct current ground path capable of carrying several amperes of current which could not be achieved by some other methods, for example, conductive plastics which would, however, provide an EMI/RFI barrier. Masking off the areas would be prohibitively expensive, even if the flexible member was not part of the ground path.

This type of plating to produce an exterior metallic surface for shielding purposes is known in the art, as shown for example, in U.S. Pat. No. 4,756,695 to Lane, et al. This assembly includes a wall box for receiving connectors therein, interconnectable to edge card connectors, which are inserted from the rear. In the '695 patent, the wall box is plated to effect a shielding for EMI/RFI. In the commercial embodiment of this connection system, two threaded inserts are included along the sidewalls which allow the box to be installed adjacent to a panel through hole, and snugged up against the back side of the panel, such that the plated box is grounded to the metallic panel.

While the above mentioned connection system is quite advantageous, the need has arisen for the insulative housing to include a plated yet flexible component. In one application the plated component is used for holding a square nut which is much more cost effective than sinking a threaded insert. A second application the plated component allows the housing to be a self locking, self grounding system, which is easier for the user to install in the panels.

The object of the invention is then to provide a method for plating an insulative component such that upon flexure of the member, the flexure does not cause a crack to propagate, thereby causing discontinuities in the plating, and further causing the flexible part to break off within a few cycles of flexing.

It is a further object of the invention to design a network interface outlet system which is easier for the user to install in the panels.

It is a further object of the invention to design a network interface outlet system which has a grounding member which is elastic and has a large deflection range to accommodate various panel thicknesses.

SUMMARY OF THE INVENTION

The above mentioned object was accomplished by designing an electrical component having an electrically plated flexible component, where the production of the component comprises the steps of providing an insulative part having a flexible beam, providing an uneven surface along the flexible beam in the area where the beam flexes and plating the flexible beam such that at least the uneven surface in the component is also plated.

In the preferred method of the invention, the uneven surfaces are provided such that the linear length along the surface is greater than a straight line distance along the beam length. In the preferred method, the uneven surface is sinuous. In the preferred method of the invention, the surface is also smooth to reduce stress riser effect.

BRIEF DESCRIPTION OF THE DRAWINGS

FIG. 9 is a rear plan view of the junction box of the instant invention.

DETAILED DESCRIPTION OF THE PREFERRED EMBODIMENT

Figure 1:
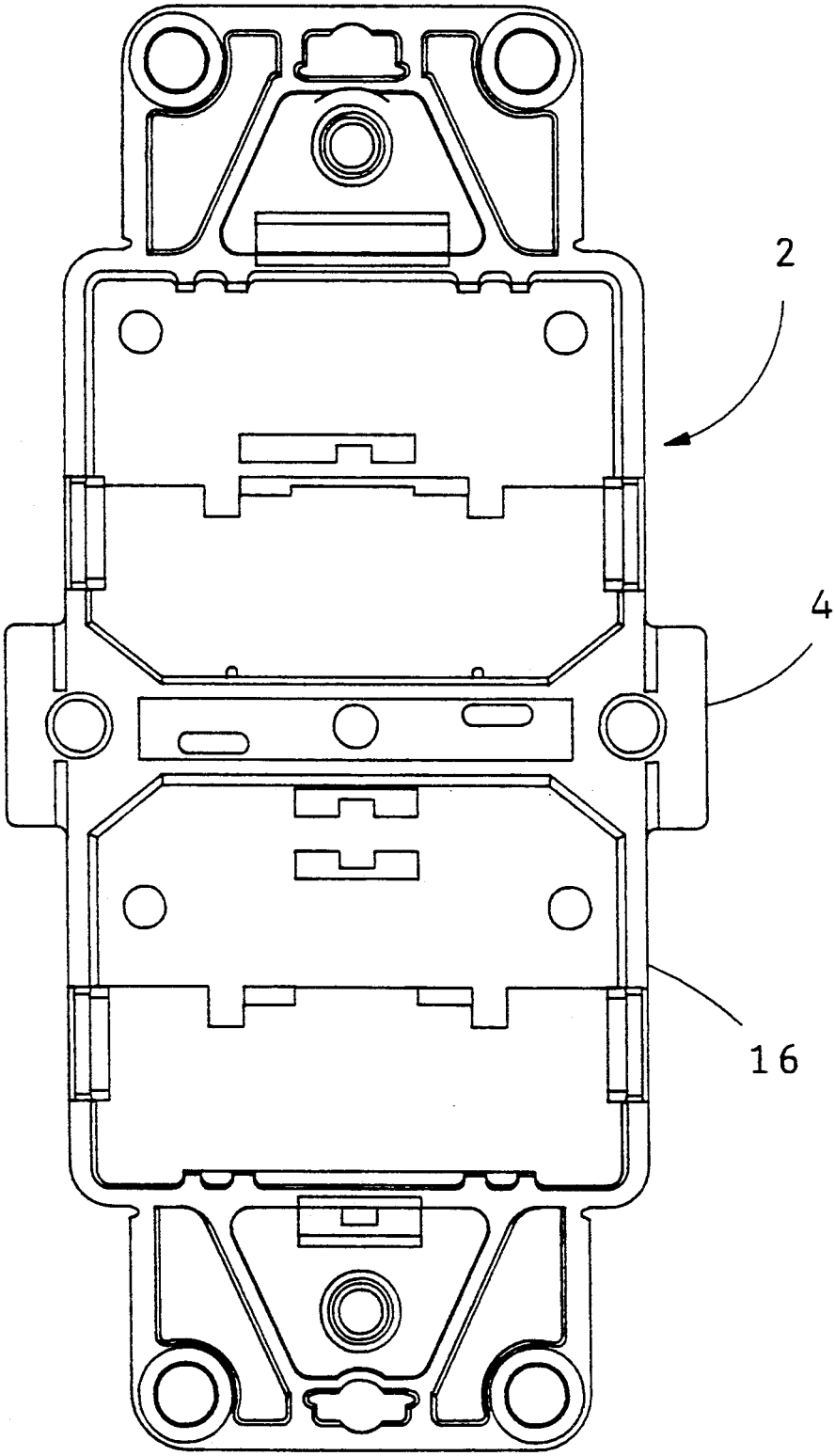
FIG. 1 is a front plan view of a typical electrical connector housing which could be plated by the inventive method.
Figure 2:
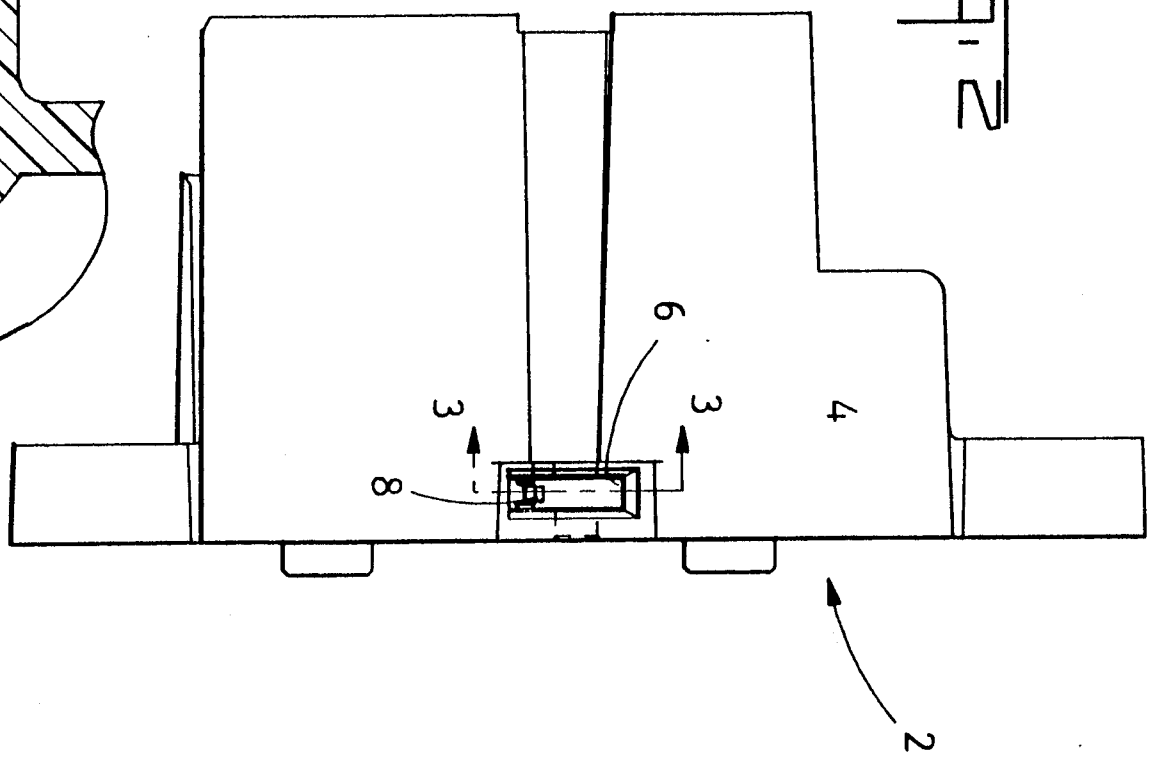
FIG. 2 is a side plan view of the housing as shown in FIG. 1.
Figure 3:
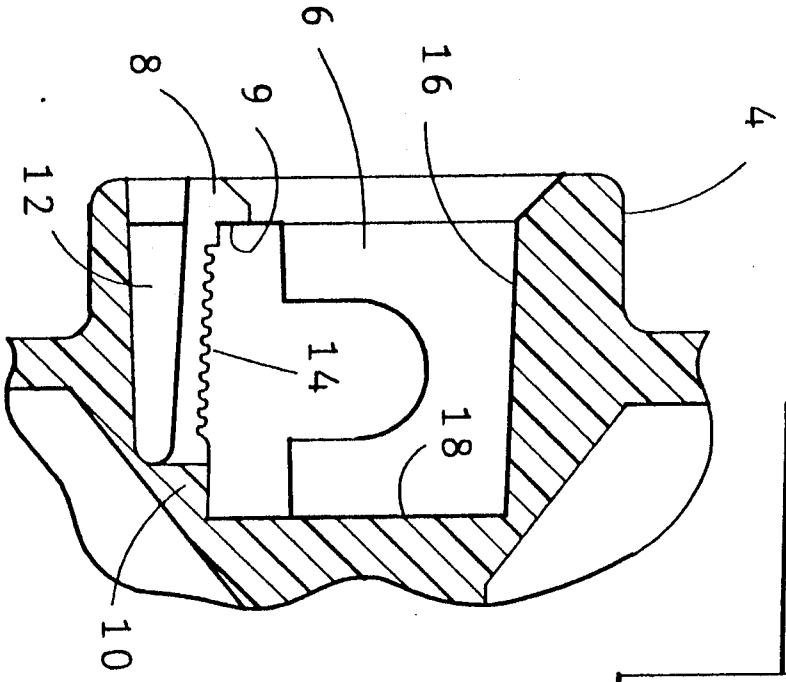
FIG. 3 is a cross-sectional view through lines 3—3 of FIG. 2.
Figure 4:
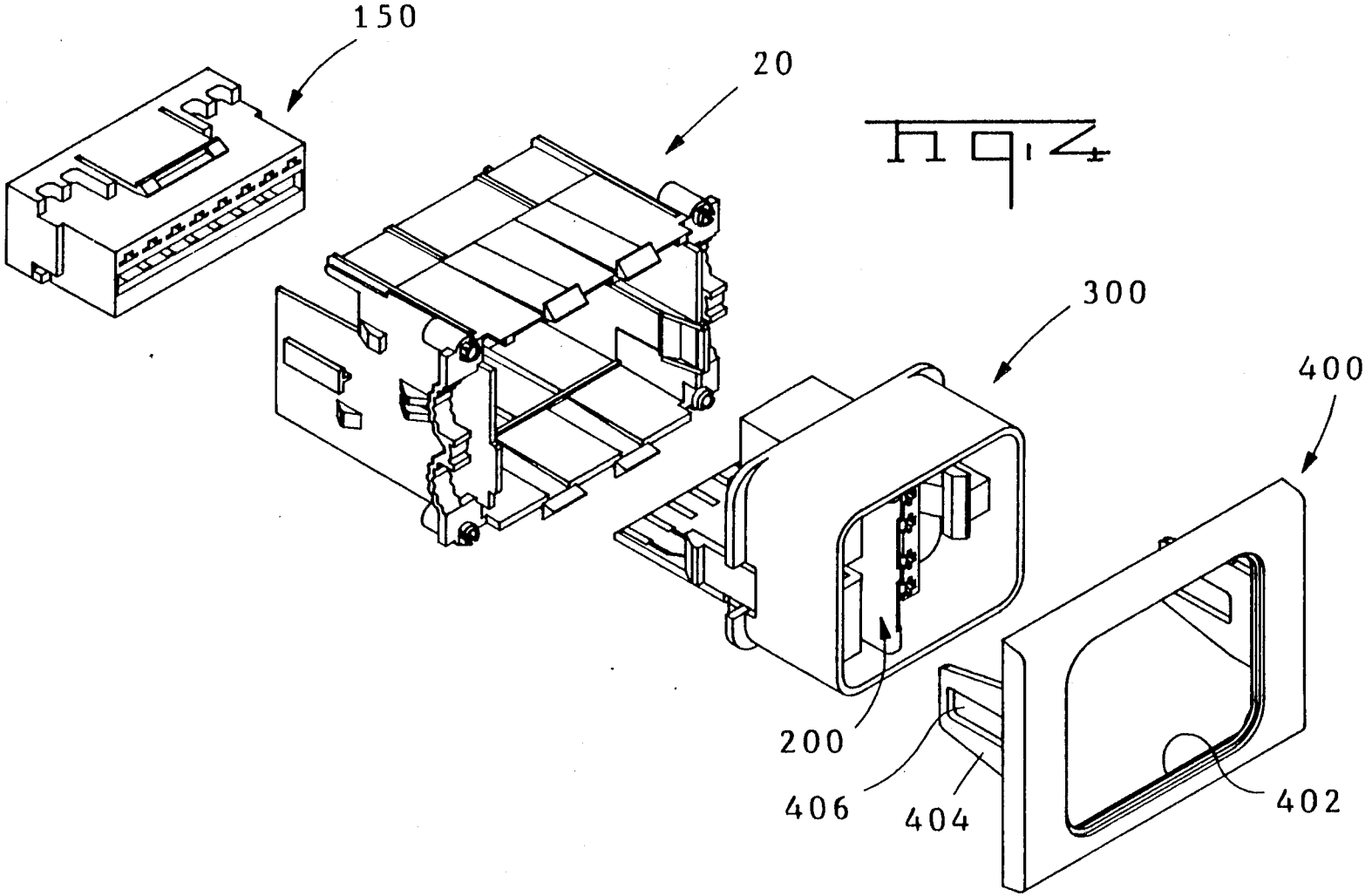
FIG. 4 is an isometric view of a second embodiment of electrical connection system utilizing the inventive method whereby components of the system are exploded away from each other.
Figure 5:
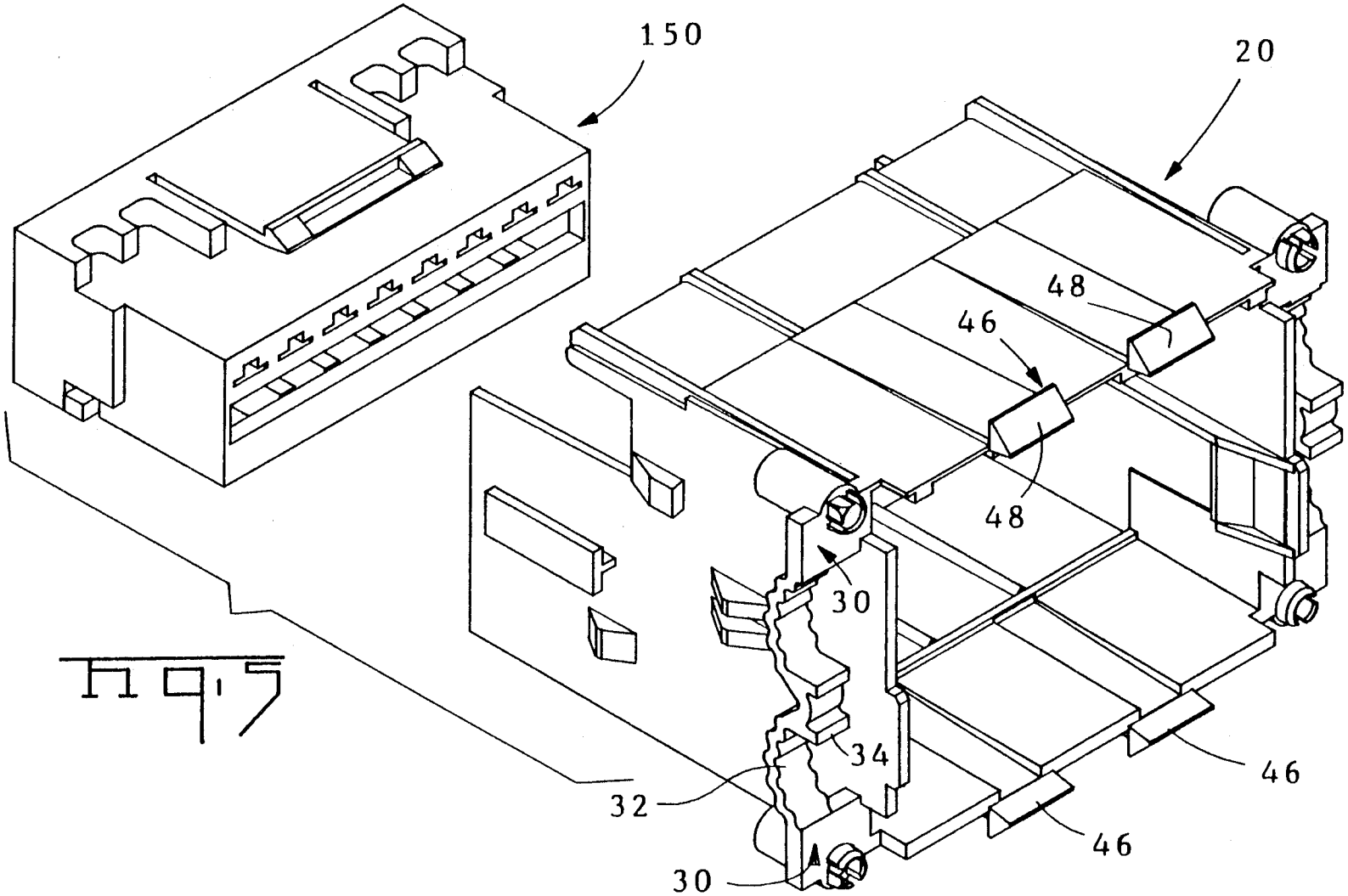
FIG. 5 is an enlarged view of the plated junction box and edge card connector.

With reference first to FIG. 1, an electrical connector housing 2 is shown which is a one piece molded item, and comprised of a plastic dielectric material. With reference to FIGS. 1 and 2, an ear 4 extends from a sidewall 16 of the housing 2 and, with reference to FIG. 2 includes a side opening 6 into the ear 4. A latch member 8 projects outwardly and, as shown in FIG. 3, comprises a beam section hinged at section 10 and includes an opening 12 beneath the beam section. On the upper surface of the beam 8 is a serrated edge 14 where, in the preferred embodiment of the invention, these serrations take on a sinuous shape. As shown in FIG. 3, the latch member 8 is defined as a beam supported at one end only.

In a plastic part such as a latch, the plastic is highly ductile, with a capability of yielding 100% or more. However, when a plastic part is plated and is used as a spring member, the spring member must be flexible and the difference in strain causes problems. For example, considering a horizontal latch bent downwardly, the upper surface is put in tension by the deflection while the lower surface is in compression. The upper surface can yield, that is, grow longer in length, to distribute the required strain over much of the surface. The total strain, that is the change in length, can approach 100% for many plastics without breaking although if deflected too far, yielding may occur resulting in a permanent set. However, if the part is unplated, the part will not break off.

When the flexible beam is now plated and is deflected a similar amount, two problems result. First, the part is much stiffer when plated. Plated samples show stiffness increasing from 1.25 pounds to deflect the unplated flexible beam whereas to deflect the same distance with a plated beam required a 7.5 pound force. Secondly, when the strain exceeds about 2.5% the metal surface cracks at the highest stress point. Since the plastic on each side of this initial crack is bonded to the metal surface, which is not to continue to move once the crack occurs, all strain is concentrated on a very small section of plastic at the bottom of the crack. This section quickly exceeds the ultimate strain limit of the plastic and the crack propagates from the metal through the plastic, causing the plastic part to break off. The best plated plastic parts are much stiffer than unplated parts and break more easily when bent or deflected.

It has been found that when an irregular pattern is formed in the surface of the dielectric part which requires the flexibility, and then the plastic part is plated, the above mentioned problem is alleviated. This surface acts as a zig-zag flat metal spring which uncoils as the part is deflected. This lowers the stiffness of the parts and it takes much less force to uncoil the spring than to yield the material. The extra length of the surface allows greater deflection without exceeding the 2½% strain limit at any one point.

As mentioned earlier, when the plated beam without the serrations was deflected 0.085 inches, the required force was 7.5 pounds versus the same part without plating requiring only a 1.25 pound force. While the serrated part did become stiffer when plated, the increased force to deflect 0.085 inches only rose from 1.25 pounds to 2.1 pounds which is a 168% increase versus a 600% increase. The serrations also increased the possible deflection before cracking from 0.125 inches to 0.290 inches, a 230% increase.

In the preferred embodiment of the invention, the surface serrations should be smooth, and sinuous if possible to reduce the stress riser effects. The amplitude of the serrations should also be large and the pitch high to maximize the plated surface length. Also, in the preferred embodiment of the invention, for reasons of effective EMI shielding, the plating is nickel over copper.

Other configurations are possible, such as a sawtooth or scalloped pattern, or most combinations of a sinuous pattern. The most important aspect is that the surfaces are smooth, and that the linear surface length of the part is greater than the straight line distance of the part.

With the latch member 8 produced in accordance with the above mentioned method, the latch is free to move within the opening 6. In the preferred embodiment of the invention, a square nut is inserted within the opening 6, and is bounded by the surfaces 14, 16, and 18, and held in place by the latch surface 9.

Figure 6:
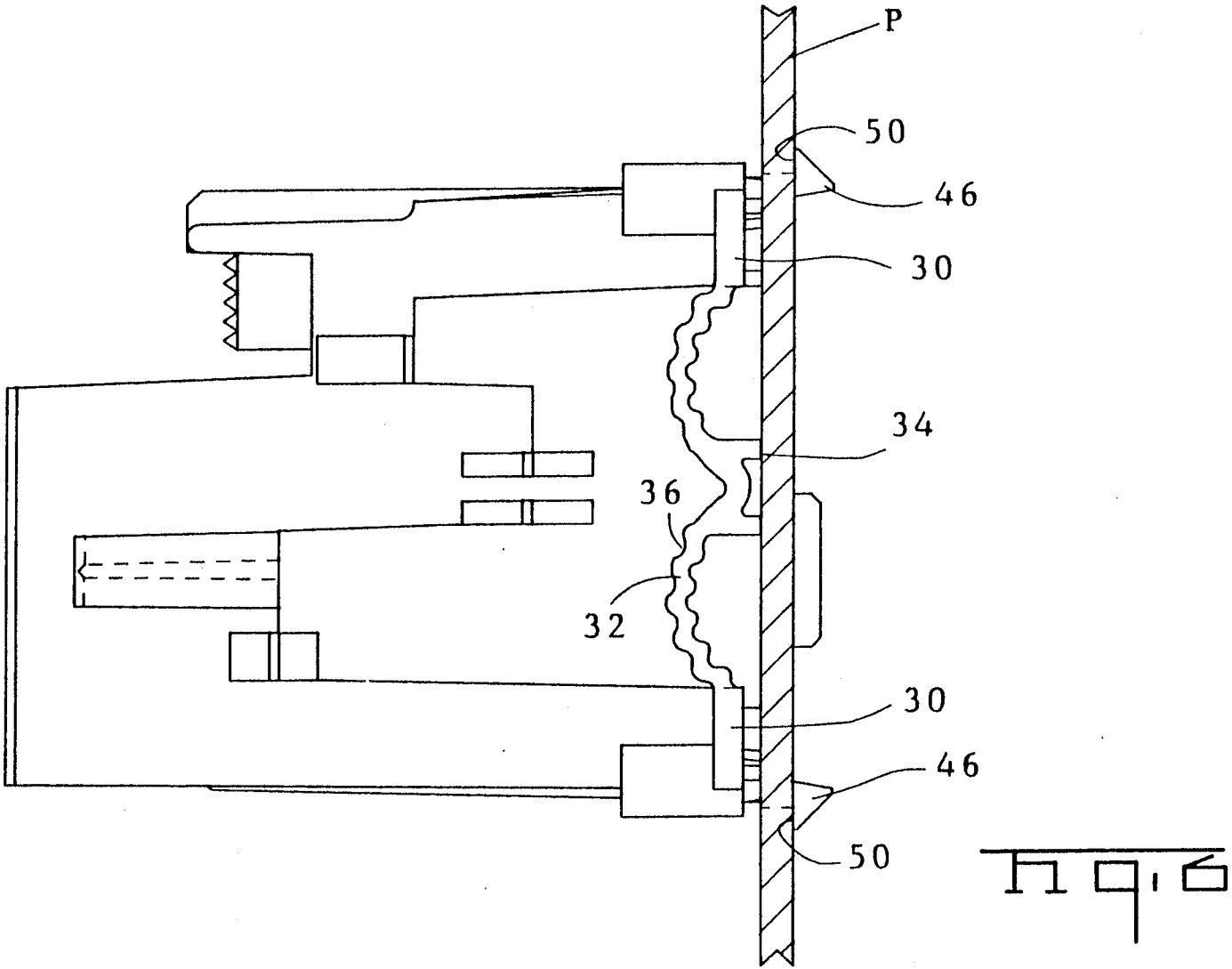
FIG. 6 is a view similar to that of FIG. 5 showing a rear shield member exploded away from the shielded junction box.

With reference to FIGS. 4–9, a second embodiment of electrical interconnection system will be described which utilizes the same inventive method. The details of the network interface shown in FIGS. 4–9 is described in greater detail in U.S. patent application Ser. No. 07/475,620, filed concurrently herewith. With respect first to FIG. 4, the local area network interface includes a shielded junction box 20, an edge card connector 150 which is insertable through the rear of the shielded junction box 20 and which receives through the front thereof a data connector assembly 200 which is latched to an adapter insert 300. A face plate 400 is then insertable over the adapter insert 30 and is snap latchable to the shielded junction box 20. On the exterior of the sidewalls are flanges 30 which include integral flexible arms 32 which include forwardly facing grounding stops 34 integral therewith. As best shown in FIG. 6, the flexible arms 32 have a sinuous curviture 36, or are corrugated in configuration which allows the resilient arms to flex without cracking the plating material which has been deposited on the resilient arms 32.

Figure 7:
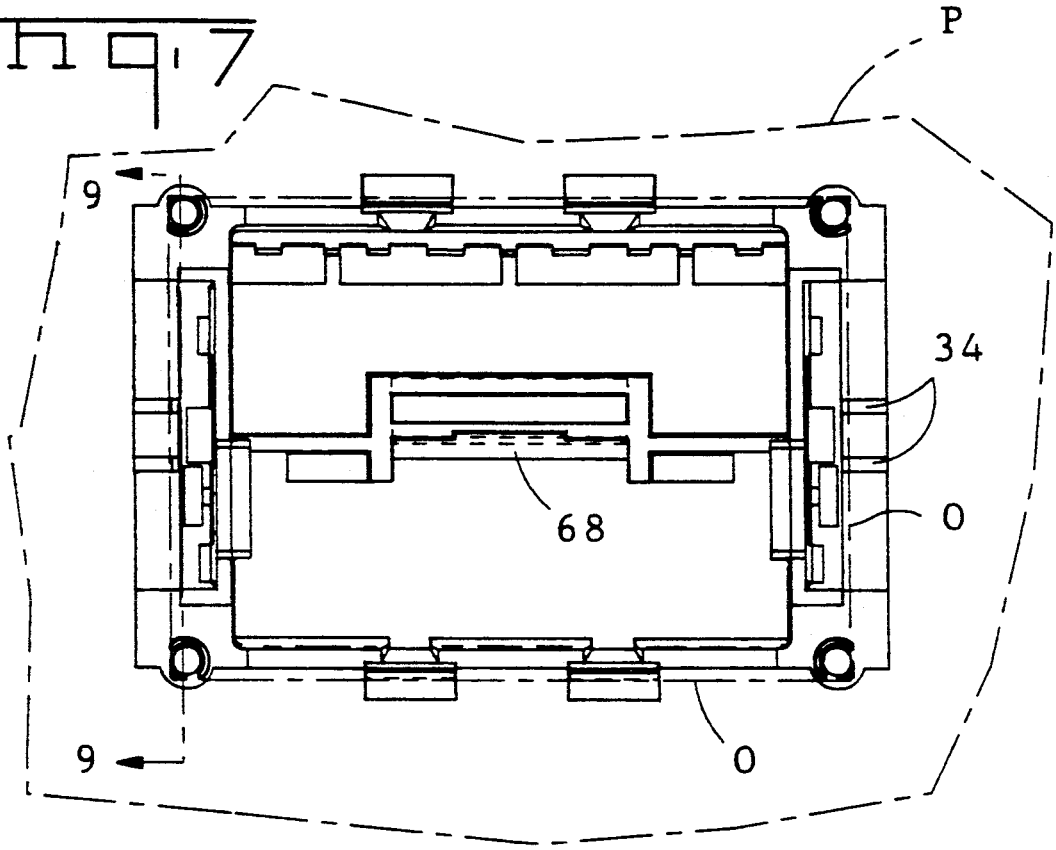
FIG. 7 is a side view showing the junction box in a snap latched configuration through a panel cut-out.
Figure 8:
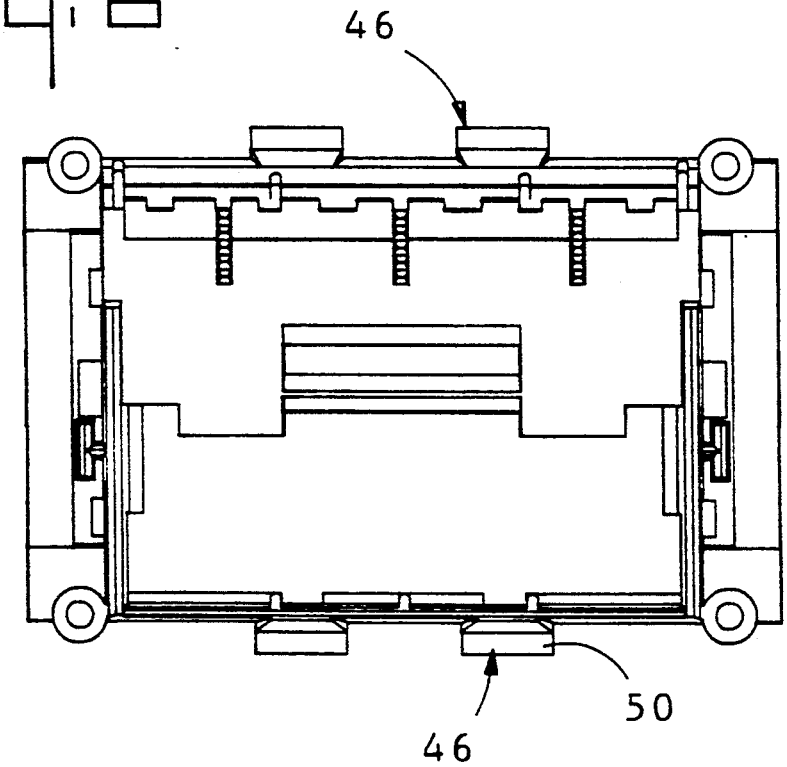
FIG. 8 is a front plan view of the shielded box of the instant invention showing the panel and its cut-out in phantom.
Figure 7:
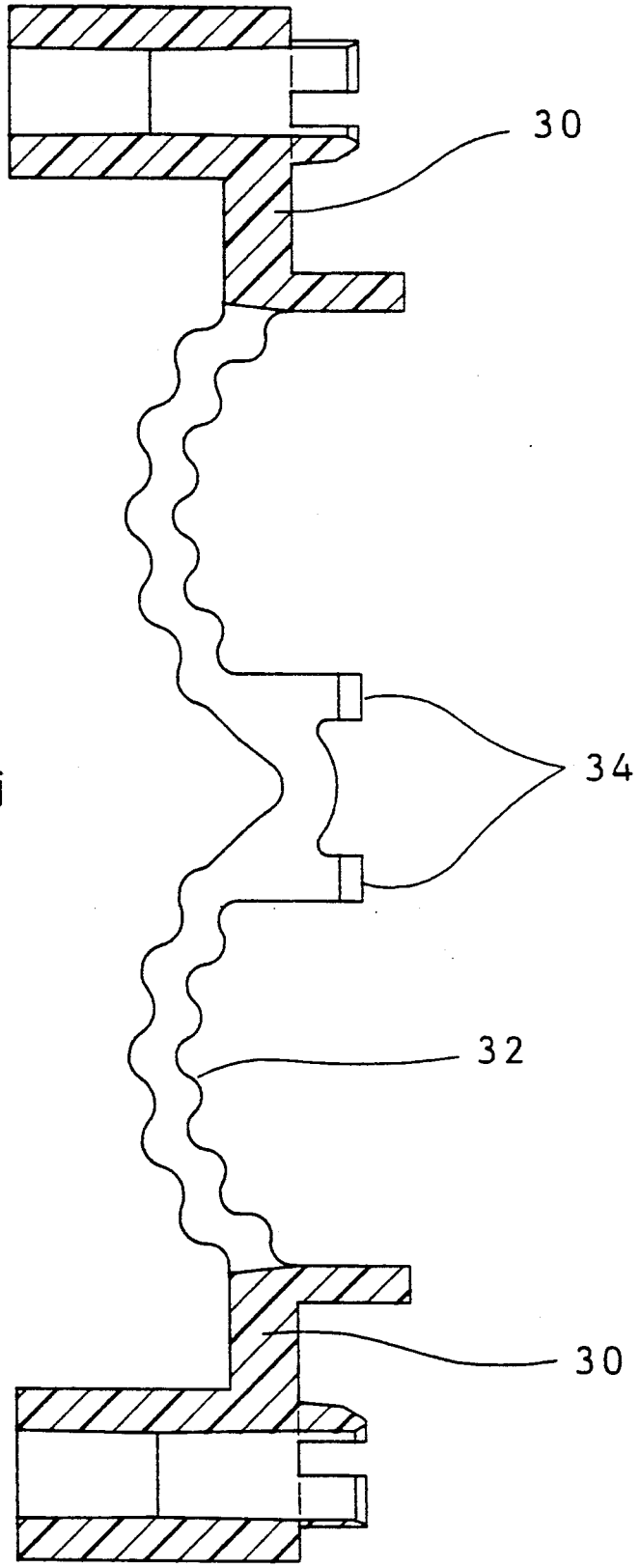

As shown in FIGS. 6 and 7, the outlet box is latchable to a panel P. In FIG. 7, the panel P is shown in phantom where the outlet box is attachable to the rear side of the panel P and mountable adjacent to an opening 0 in the panel P. The latch members 46 and the flexible arm members 32 cooperatively assist in mounting the outlet box 20 to the panel, without the use of extraneous hardware. As shown in FIGS. 6 and 7, the latch members 46 are insertable through the opening 0 of the panel P, such that the rearwardly facing surfaces 50 abut the front face of the panel P as shown in FIG. 6. Conveniently, the flexible arms 32, which flank the outlet box 20, are wider than the opening 0 in the panel P and therefore the grounding lugs 34 abut the rear face of the panel P. These surfaces 50 and 34, therefore cooperatively retain the outlet box to the panel.

It should be understood that the distance between the surfaces 50 and 34, when the box is not inserted in the panel P, is less than the thickness of the panel P. In other words, the arms 32 are resilient to accommodate the thickness of the panel P therebetween. Advantageously, due to the inventive method, the arms 32 are resiliently flexible to accommodate a variety of thicknesses of panels, without cracking the plating on the flexible arms 32.

We claim:

1. In an electrical connector having an electrically plated flexible member, a method of producing the member comprises the steps of:

providing an insulative part having a flexible member, providing an uneven pattern on the exterior surface of the member in the area where the member flexes, plating the flexible member, such that at least the uneven surface in the member is also plated.

2. The method of claim 1 wherein the uneven surfaces are provided such that the linear length along the surface is greater than a straight line distance along the beam length.

3. The method of claim 2 wherein the uneven surface is produced as a rounded surface.

4. The method of claim 3, wherein the uneven surface is sinuous.

5. The method of claim 1 wherein the uneven surface is integrally molded into the insulative part.

6. The method of claim 1 wherein the flexible member is produced as a cantilever beam, supported at one end only.

7. The method of claim 1, wherein the member is shaped as an outlet box and provided with at least one opening therein for the receipt of an electrical connector.

8. The method of claim 7, wherein the outlet box is provided with latch members extending from the front face thereof and flexible arm members extending from side edges of the outlet box, the flexible arm members being bow shaped and having grounding surfaces thereon, which latch the outlet box in place to a panel, and simultaneously ground the box to the panel.

9. The method of claim 8 wherein the flexible arms are connected at each end to flanges which are integral with the housing, and the grounding surfaces are intermediate to the bow sections.

* * * * *